United States Patent [19]

Cove

[11] 4,185,534

[45] Jan. 29, 1980

[54] STRINGED MUSICAL INSTRUMENTS WITH FOAMED SOLID BODIES

[76] Inventor: Les Cove, 546 Chapman St., Hillside, N.J. 07265

[21] Appl. No.: 970,954

[22] Filed: Dec. 27, 1978

Related U.S. Application Data

[63] Continuation-in-part of Ser. No. 807,971, Jun. 20, 1977, abandoned.

[51] Int. Cl.[2] ..... G10D 3/02

[52] U.S. Cl. ..... 84/291; 84/452 P

[58] Field of Search ..... 84/173, 193, 267, 275, 84/291, 452 R, 452 P

[56] References Cited

U.S. PATENT DOCUMENTS

| | | | |
|---|---|---|---|
| 3,396,621 | 8/1968 | Dycus | 84/267 X |
| 3,618,442 | 11/1971 | Kawakami | 84/193 X |
| 3,664,911 | 5/1972 | Takabayashi | 84/291 X |
| 3,669,214 | 6/1972 | Matsuura et al. | 84/193 X |
| 3,769,871 | 11/1973 | Cawthorn | 84/291 |

FOREIGN PATENT DOCUMENTS

| | | | |
|---|---|---|---|
| 697869 | 11/1964 | Canada | 84/291 |

*Primary Examiner*—Lawrence R. Franklin
*Attorney, Agent, or Firm*—John A. Shedden

[57] ABSTRACT

This invention relates to the use of a foamed polymeric material in the fabrication of solid-bodied, stringed musical instruments with the preferred material being a homogeneous body of foamed polystyrene having a density of from about 0.5 to about 6 pounds per cubic feet. Since the neck assembly must of necessity have greater structural strength than the body, it is contemplated using a relatively simple disconnect mechanism for coupling same to the body. Although the essence of the invention lies in the fact that with the foamed solid body additional sounding amplification means are unnecessary, electrical amplification can optionally be added to said instruments.

8 Claims, 2 Drawing Figures

STRINGED MUSICAL INSTRUMENTS WITH FOAMED SOLID BODIES

This application is a continuation-in-part of my prior co-pending application Ser. No. 807,971, filed June 20, 1977, now abandoned.

BACKGROUND OF THE INVENTION

1. Field of the Invention

This invention relates to stringed, musical instruments classified as chordophonic instruments such as violins and guitars, and more particularly to the construction of sounding bodies for such instruments.

2. Description of the Prior Art

The different types of chordophonic stringed instruments which are available are distinguished mainly by the construction of their bodies and the manner in which sounding boxes and boards are incorporated into the bodies to reinforce the tone of the strings by sympathetic vibrations. Also the quality of the tone of an instrument is determined by the construction of the body and to exemplify this, one merely has to compare the tones of violins, mandolins, guitars, bass viols and lutes.

It is currently accepted that as a sounding box or enclosure within the body of a stringed instrument becomes larger, the resonance becomes increased and conversely, as the volume of the sounding box becomes less, the resonance diminishes accordingly with concommitantly decreasing tonal quality.

Typically, the sounding box within the hollow body of an instrument is covered on the front face by a thin plate which desirably provides a substantially unencumbered decorative cover with sounding holes.

In recent years, amateur and professional instrument makers have been experimenting with different types of bodies for chordophonic stringed instruments with various objectives in view. Often the body design is changed to enhance the appearance of the instrument or to produce distinctive tonal characteristics but these changes are necessarily limited for one always has to recognize, i.e. design around, presence of the sounding box. When body designs are such that the sounding box is totaly eliminated, as in solid body guitars, the deficiency in the amplification of the string vibrations is, of necessity, overcome by the use of pick-up devices which transfer the vibration signals to an electronic amplification-speaker system which, of course, is a significant added expense.

It is, of course, apparent that even a flat fretted stick with strings stretched thereon can be considered a musical instrument. However, the tones produced by the strings will be barely audible. Such a stick-like instrument has heretofore found utility only as a practice instrument where it is desired to subdue the tones produced. Sound amplification in some manner is essential to provide a true musical instrument and, as mentioned above, in conventional instruments, a sounding box within a hollow body is provided, often with one or more sections of the body defining the box itself.

When large volume sounding boxes are utilized in order to achieve desired tone characteristics, the body of the instrument must also be large to accommodate the sounding box. A prime example of this is a musical instrument commonly referred to as a "bass". Technically such an instrument should be termed a "bass viol", since it is the largest member of the viola da gamba family of musical instruments.

To avoid excessive weight—for the material of construction is usually wood—and for other accoustically related reasons, the shell of the instrument body is often quite thin and fragile. Therefore, great care must always be taken to protect the instrument from impact or environmentally-related damage; such as rain-induced warpage.

The intricate processes involved in the often quite complex construction of the hollow-bodied shell structures of stringed musical instruments, of course, contribute considerably to the high cost of such instruments.

SUMMARY OF THE INVENTION

The present invention is directed toward providing stringed musical instruments that produce good, rich tones comparable with the tones of conventional instruments such as violins and guitars with excellent amplification of the string vibrations without sound boxes or electrical amplification-speaker systems.

It is an object of the present invention to produce such stringed musical instruments as referred to above which will not be affected by physical environmental changes and the like.

It is also an object of the present invention to provide stringed musical instruments which are ideal for growing children for the instruments will be neat-appearing, capable of high quality performance and light in weight, yet rugged with the material of construction of the body presenting no toxicological hazard or odor. Further, if the body of an instrument becomes smashed or broken, as musical instruments are wont to do in the hands of children, there is no danger of harming or cutting the user.

It is yet another object of the present invention to provide stringed musical instruments of the type referred to above which will be simple and inexpensive in construction yet will be conducive to a long trouble-free life.

These and other objects are achieved according to the present invention by providing stringed musical instruments with homogeneous "solid" bodies composed of cellular, i.e., foamed resin, preferably polystyrene. It has been found that when this material—which heretofore has been utilized in sound dampening and insulation end-uses is used to form a solid body of a stringed musical instrument with a single surface area to depth ratio in the range of from about 16:1 to 550:1; preferably from about 50:1 to about 300:1, i.e., thick self-supporting solid bodies as opposed to thin diaphragms, sheets or sounding boards. Quite surprisingly the material resonates and amplifies the string vibrations to such an extent that rich, clear tones are produced without the need for a hollow, interiorly positioned, sounding box.

According to a preferred embodiment of the present invention, the body is provided with an axial cavity means for receiving an instrument neck assembly, i.e., a neck, bridge, and tail piece unit such as that found on a guitar.

These together with other objects and advantages which will become subsequently apparent reside in the details of construction and operation as more fully hereinafter described and claimed.

DESCRIPTION OF THE PREFERRED EMBODIMENTS

The present invention resides in the discovery that thick "solid" homogeneous blocks of foamed resin such as polystyrene act as amplifying resonators for vibrations from attached or closely associated strings. A pre-tuned neck assembly by itself, that is, a braced neck with associated tuning pegs, strings, frets, bridge and tail piece, when plucked gives a barely audible sound. The same result occurs even when the neck assembly is attached to a solid block of some material such as wood or plastic. A prime example of this is the present day solid body electric guitar which, when the electrical power is turned off, only will produce barely audible, low quality tones. Surprisingly, when a pre-tuned neck assembly as described above is attached to a block of foamed resin, the sound produced is of a quality and amplification reasonably comparable to that of conventional hollow-body stringed instruments.

Since the necessity of a hollow sounding box has been obviated by the present invention, the possible body shapes realizable are now virtually unlimited. This posture, of course, is qualified by recognition of the general principle that the larger the foamed solid body of the instrument, the greater the sound levels produced.

Kawakami (U.S. Pat. No. 3,618,442) and Takabayashi (U.S. Pat. No. 3,644,911) have disclosed the use of foamed resins for use as thin sounding boards or diaphragms in musical instruments but both were troubled by the considerable decrease in output level when such foamed resin was used in thin sections as a result of the inherently small Young's modulus of this material. In order to overcome this deficiency, both teach the addition of at least a thermosetting resin to bind the foam, which has been granulated to form an integral structure i.e., neither reference contemplates the use of solid homogeneous blocks of foamed material or the use of such material in thick sections.

Interchangeable neck and finger board assemblies are well known in the art as exemplified by U.S. Pat. Nos. 3,396,621 and 3,439,570. Although neck assemblies could be permanently attached to the foamed body of the instrument, a preferred embodiment of the present invention utilizes a disconnect feature. The solid-body, foamed construction provides a highly versatile stringed musical instrument in that when the neck assembly is coupled in restrained sliding relation to the body, for example, in an axially oriented body cavity, one can, upon release of a brake or like mechanism, remove the neck assembly and exchange either the neck or body to create a differently sounding stringed instrument. Of course, one can also axially shift or reshift the neck assembly with respect to the body at any moment desired for the purpose of obtaining and retaining a comfortable playing position regardless of which part of the finger board is to be fingered. This is especially advantageous for teaching novice players, especially children. As an aside, the sliding neck assembly if desired can be made much longer than standard neck assembly lengths whereby the instrument is capable of producing musical notes over a musical range far greater than is possible with conventional stringed instruments.

BRIEF DESCRIPTION OF THE DRAWINGS

Referring now to the drawings, there is shown a stringed musical instrument such as a guitar broken down into the neck assembly (FIGS. 1, 10) with fretted finger board, tuning pegs, strings, bridge, and tail piece and the solid, homogeneous body (FIGS. 1, 20) with a slot cut into said body to accept snugly said neck assembly. The cutaway drawing of 20, i.e., FIG. 2 depicts the non-hollow, i.e., "solid" homogeneous structure of the bodies of the instant invention.

Figures 1, 2:
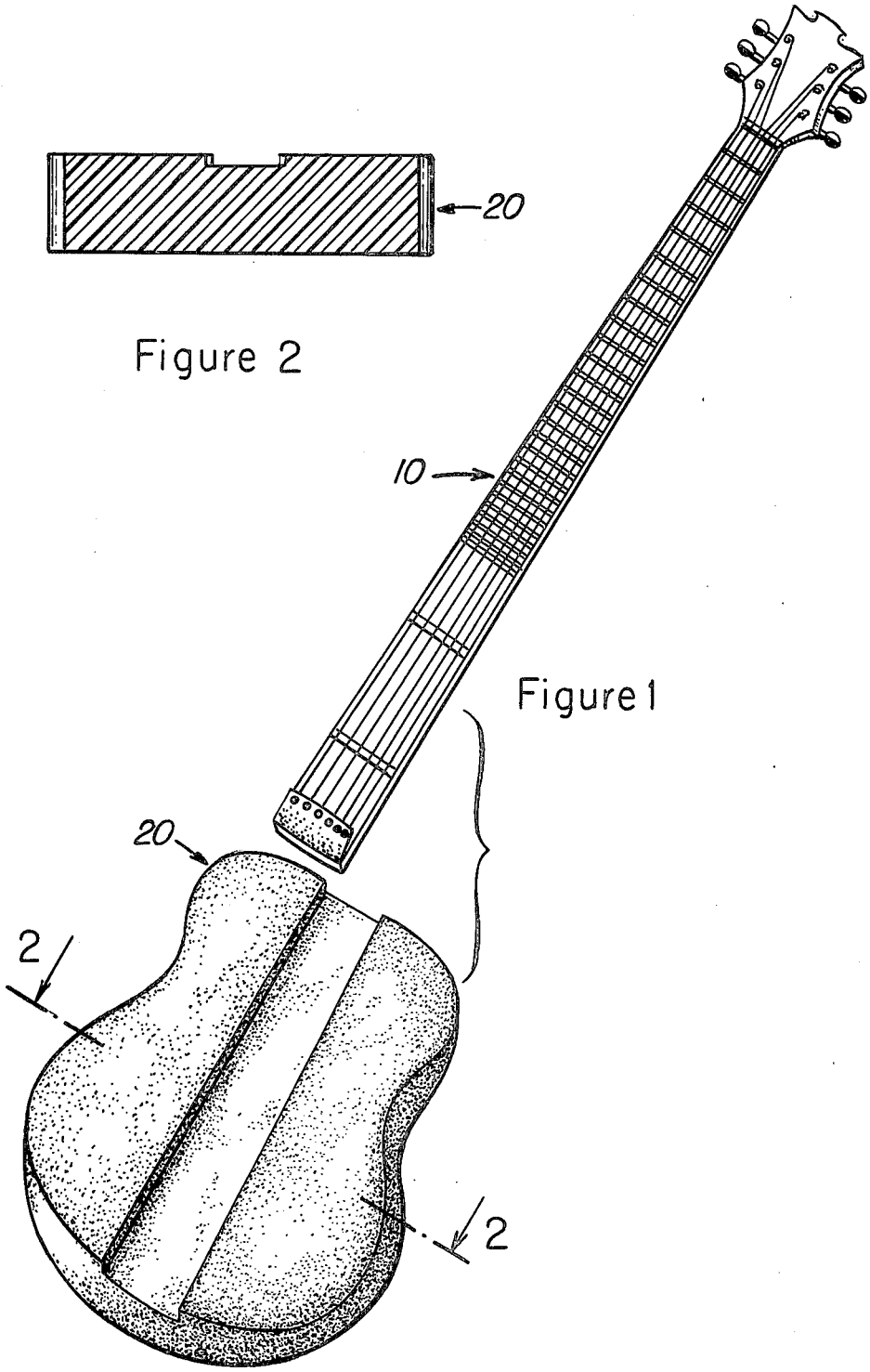
FIG. 1 shows an exploded perspective of the guitar neck and body.
FIG. 2 shows a cross-section of the body as seen in the direction of arrows 2—2 in FIG. 1.

This ease of interchangeability of the body with the pre-tuned neck assembly is especially important in the case of child users of the instrument for when the child is small the relatively inexpensive construction of the body of the musical instrument makes it feasible as well as quite practical to purchase one that conforms in size and contour to the child's size and, of course, selectively increase the body proportions of the instrument while retaining the same neck assembly as the child grows.

Of course, the significantly lighter weight of the bodies of the instant invention will prove a boon to children learning to play who often find the weight and bulkiness of conventional stringed instruments to be difficult and cumbersome to manipulate properly.

Musical instruments, such as those of the instant invention, which can be conveniently taken apart and/or knocked down to relatively small, lightweight, components, can not only be easily transported and/or carried but can also more easily fit into cases of comparatively rational size. This is especially important with the larger musical instruments such as the basses which frequently, because of their ungainly bulky size, are refused transport by public transportation.

The ease of machinability makes it relatively simple to fasten to and/or through the foamed body of the instruments of the instant invention a plurality of suitable known devices and/or control elements if desired. It is contemplated that these include pickups, such as electromagnetic pickups, toggle switches, volume controls, tone controls, and output jack controls for subsequent hookup to an electrical amplification-speaker system. Of course, openings can easily be provided for connecting wires associated with the above.

The expandable polymeric materials contemplated for use in the construction of the bodies of the musical instruments of the instant invention can be made from a variety of homopolymers and copolymers derived from hydrocarbon vinyl monomer. Such monomers are, for example, ethylene, styrene, nuclear dimethyl styrenes, isobutylene, vinyl naphthalene, polyvinyl halide compounds, polyvinyl acetate, nylon, etc. and such copolymers are, for example, styrene and butadiene, styrene and $\alpha$ methyl styrene, styrene butylene and $\alpha$ methyl styrene, styrene and isobutylene, styrene and dimethyl styrene, isobutylene and butylene. Preferred polymers that are useful are polystyrene and its copolymers with such monomers as butylene, $\alpha$ methyl styrene and $\alpha$ isobutylene. The most preferred polymer is polystyrene.

Although properties of foam materials are related to the resin, the cellular structure is of primary importance. With a given cell size and uniformity, strength properties decrease linearly with density.

The principal types of resin foam are classified primarily according to density and, in turn, by processing procedure employed and although desired tonal characteristics and structural strength will determine the final required density, foam from about 0.5 to 50 lb./ft.$^3$ can be used to form the bodies of the chordophonic stringed musical instruments of the instant invention. The preferred density in the finished product is from 0.5 to 16 lb./ft.$^3$ with the most preferred being a low density product of from 0.5 to 6 lb./ft.$^3$.

It is anticipated that the solid homogeneous blocks of foamed resin will be used in generally the overall outside shape of conventional, i.e., "hollow" bodied instruments in use today; therefore, the single surface area to depth ratio will be in the range of from about 16:1 to 550:1; preferably from about 50:1 to about 300:1, i.e, thick self-supporting solid homogeneous bodies as opposed to thin diaphragms or sounding boards.

The stringed musical instrument bodies of the instant invention can be formed essentially three different ways. The first is via a closed mold molding procedure; the second by means of an injection molding process; and the third, by carving the body from a solid block or board of the foamed material.

The closed mold molding procedure generally uses expandable polymeric beads usually prepared by a suspension polymerization in which there is incorporated from about 3 to about 30 parts by weight of an aliphatic or cyclo aliphatic hydrocarbon boiling in the range of from about 35° to 60° C. Suitable hydrocarbons include petroleum ether, m-, neo-, and isopentane, hexane, heptane, cyclo-pentane, cyclo-hexane, cyclo-pentadiene, and esters thereof. Typical of the pressure methods used for preparing these beads is that taught in U.S. Pat. No. 2,983,692.

Although the expandable polymeric particles are generally known as beads, they may be round, pillow-shaped, or irregularly shaped.

Polystyrene beads suitable for the purpose of the instant invention are sold commercially by such companies as Badishe Anilin & Soda Fabrik A.G. of Ludwigshafen, Germany, under the trademark "Styropor", by Koppers Company Inc. of Pittsburgh, Pa., U.S.A. under the trademark "Dylite", and by Dow Chemical of Canada, Ltd. under the trademark "Pelaspan". The expandable polystyrene beads originally have a density usually of approximately 32 pounds per cubic foot. These small beads which are impregnated with the foaming agent are of a size which, of course, varies with the manufacture but is of the order of sixty to seventy-thousandths of an inch in diameter.

The expandable polymer beads can be charged directly into a mold having the desired musical instrument body shape, expanded, and fused by heat however in order to achieve a more uniform density the preferred technique is to first pre-expand the beads. This pre-expansion or preforming must be carried out in order to assure complete expansion of the material and to obtain uniform densities and cohesion between the various beads. Particularly useful processes for pre-expanding the beads are taught in U.S. Pat. Nos. 3,023,175 and 2,998,501 in which hot gas, infrared, steam and high frequency radio waves are used to heat the polymeric material to predetermined temperatures for a predetermined time which is advantageously short, thereby to partially expand a predetermined amount of the polymeric material. This pre-expanded material is then charged into a body-shaped mold, and fused with a source of heat which may be metal dielectric electrodes, a hot liquid such as water, or hot gases such as steam.

In the United States, three methods are most commonly used for injection molding thermoplastic foam.

One is a low pressure process licensed by Union Carbide Corp. with mold pressures from about 300 to 400 psi and the second is a high pressure USM process, i.e., 10,000 to 20,000 psi—both of which involve injection equipment of special design. The third process uses conventional injection molding presses.

The low pressure process involves plasticizing in a conventional extruder followed by introduction of a normally gaseous, expanding medium in the feed zone. The term "normally gaseous, expanding medium" is intended to mean that the expanding medium employed is a gas under normal atmospheric pressures and temperatures, although at the pressure at which it is introduced it may be in the liquid state.

Nitrogen is normally the gas used to produce cellular plastic products but in place of the nitrogen, other normally gaseous elements, compounds or mixtures thereof may be used as the agent to produce said products. Among the other elemental gases that might be employed with satisfactory results are argon, neon and helium.

In addition normally gaseous organic compounds may be used to expand the plastic material. Among the most important of these are the halogen derivatives of methane and ethane, which are used as refrigerants and for similar purposes, such as chlorodifluoromethane, dichloro difluoro methane, dichlorofluoro methane, trichlorofluoro methane, difluorotetrachloro ethane, dichlorotetrafluoro ethane, dichlorofluoro ethane, 1,1 difluoro ethane, ethyl chloride, methyl bromide, methyl chloride, and trichlorofluoro methane.

Other normally gaseous compounds that may be employed are acetylene, ammonia, butadiene, butane, butene, carbon dioxide, cyclopropane, dimethyl amine, 2-2 dimethyl propane, ethane, ethyl amine, ethylene isobutane, isobutylene, methane, monomethyl amine, propane, propylene, and trimethyl amine.

The molten resin containing the dissolved gas is collected in a piston accumulator and held under pressure to prevent expansion. Finally sufficient resin for one shot is released into the body-shaped mold cavity. The foam structure develops during filling of the mold because of a rapid reduction in pressure. However, a smooth dense surface is very difficult to produce with this technique.

In the other two high pressure injection molding procedures, not only are solid blowing agents compounded into the plasticized resin prior to injection but the mold is cooled slightly to allow a smooth skin formation on the surface of the interior-foamed molded body. Additionally, the USM technique utilizes a volume expansion of the cavity induced by programmed mold movement. The smooth outer surface finish is highly desirable for it renders the body (1) more resistant to compressive forces; (2) more abrasive resistant; and (3) more resistant to fluid impregnation. Also when the surface of the instrument body is relatively uneven, deposits such as dust easily collect and are difficult to remove.

It is appreciated that there are many techniques available in the art for achieving smooth skin effects on foamed bodies typical of which is the solvent injection procedure taught in U.S. Pat. No. 3,476,841.

Finally, the body of the stringed musical instruments of the instant invention can be fabricated out of a solid block or board of the foamed material.

Cutting techniques include sawing with hand or jig saws. Cutting with a hot wire is another useful procedure since it permits the cut to be intricately shaped and affords a harder, smoother surface than that which results from sawing.

There are two basic approaches to making foams such as polystyrene into boards. One of these involves starting with a polystyrene melt into which is injected a volatile liquid such as methyl chloride. This is held under pressure until it is extruded from an orifice to produce a log about two feet in diameter which is then sawed into boards. A second approach consists of molding expandable beads into boards. Methods have been developed for making such boards batchwise, in pieces as large as 4×12 feet with thicknesses up to 20 inches. Continuous procedures using said beads presently yield a product up to 12 inches thick and about two feet wide. Typical of said continuous processes is the technique taught in U.S. Pat. No. 3,178,768.

EXAMPLE I

The following is a typical preferred method of constructing an instrument of the instant invention.

A four inch thick block of homogeneous foamed polystyrene—density of 0.6 pounds per cubic foot—is cut into the standard curvaceous figure-eight configuration of a Spanish guitar, i.e., fourteen inches across at the widest point and twenty four inches in length. A three inch wide, open slot about one inch deep is cut from the front face of the "solid" body. This slot is positioned at the midpoint of the body and runs axially from the leading edge to the rear. The cut surfaces are sanded smooth. The single surface area to depth ratio of this solid body is slightly less than about 326 inches to 4 inches thick or about 82:1.

A guitar neck assembly, comprising a neck with fretted fingerboard tuning pegs, strings, bridge and tail piece unit, is shaped so that the assembly fits snugly within said slot. It is found that the inherent flexibility of the body is such that the neck assembly will be firmly gripped.

This instrument resonates and amplifies the string vibrations and rich clear tones are produced.

EXAMPLE II

An instrument is prepared as in Example I but in addition, material is scraped from the back of the "solid" body to form a concave surface. This results in an instrument with sound quality comparable to that of Example I, however, the volume is noticeably increased.

EXAMPLE III

An instrument is prepared as in Example I, however, the neck assembly is constructed from multiple tubes of aluminum. That is, the fretted fingerboard, tuning pegs, strings, bridge and tail piece are connected to at least two tubes of aluminum which provide the structural strength necessary for the neck assembly. Of note, the fingerboard does not cover the tubing inserted into the "solid" body slot and, as a result the sound is even more enriched from this unit, as compared to the above Examples—apparently as a result of the recessed curved surfaces of the tubes which are exposed under the plucking area of the strings.

It is also contemplated to insert a plastic or aluminum gripping sleeve within the "solid" body slot to prevent foam breakdown from repeated entry and exit of the neck assembly. This gripping sleeve can be with or without a braking/locking mechanism.

The stringed musical instrument bodies of the instant invention, especially those made of foamed polystyrene are relatively resistant to chemical reagents and various environmental conditions. The material is not attacked by alkali media and most acids. It also has relatively good stability of properties from sub-freezing to 175° F. Not only is the material exceptionally strong, wet or dry, but it is water resistant and buoyant. All of the above illustrates that the stringed musical instruments of this invention with bodies formed from the cellular foam are ideal for use around swimming pools, at the beach, or taken hiking without the attendant fear of having the instrument exposed to the outdoor environment.

Since foamed polystyrene is considered unobjectionable for use in contact with food for human consumption, fungus cannot attack it; nor can bacterial growth be supported, instrument bodies fabricated from said material are ideal for both use by children and less than ideal, long term storage.

Many of the suppliers of foam or foamable material have a self-extinguishing as well as a regular grade and so it is contemplated that this material will be used in appropriate circumstances.

The instrument bodies of this invention include those whose surfaces are covered with paint or bonded to thin sheets of felt, vinyl, etc.

The foregoing detailed description is to be clearly understood as given by way of illustration and example only, the spirit and scope of this invention being limited solely by the appended claims.

I claim:

1. A stringed musical instrument having a solid body with a single surface area to depth ratio in the range of from about 16:1 to about 550:1; a neck assembly, and means connected to said body for receiving said neck assembly; the improvement comprising fabricating said solid body from a homogeneous foamed polymeric material.

2. A structure as defined in claim 1 wherein the density of said foamed polymeric material is from about 0.5 to about 50 pounds per cubic foot.

3. A structure as defined in claim 1 wherein the density of said foamed polymeric material is from about 0.5 to about 16 pounds per cubic foot.

4. A structure as defined in claim 1 wherein the density of said foamed polymeric material is from about 0.5 to about 6 pounds per cubic foot.

5. A structure as defined in claim 1 wherein the polymer material is polystyrene.

6. A structure as defined in claim 1 wherein the single surface area to depth ratio is in the range of from about 50:1 to about 300:1.

7. A structure as defined in claim 1 wherein said solid body is self extinguishing.

8. A guitar having a solid body and a neck assembly, the improvement comprising fabricating said solid body from foamed polystyrene having a final density of from about 0.5 to about 6 pounds per cubic foot.

* * * * *